US005884546A

United States Patent [19]

Johnson

[11] Patent Number: 5,884,546

[45] Date of Patent: Mar. 23, 1999

[54] PUNCH UNIT

[75] Inventor: Gary E. Johnson, Ramsey, Minn.

[73] Assignee: Mate Precision Tooling Inc., Ramsey, Minn.

[21] Appl. No.: 803,684

[22] Filed: Feb. 21, 1997

[51] Int. Cl.[6] ..... B26F 1/14

[52] U.S. Cl. ..... 83/530; 83/140; 83/686; 83/698.91

[58] Field of Search ..... 83/136, 139, 140, 83/686, 698.91, 699.31, 699.41, 530, 684

[56] References Cited

U.S. PATENT DOCUMENTS

| | | | |
|---|---|---|---|
| 389,404 | 9/1888 | O'Neill | 83/686 |
| 2,974,967 | 3/1961 | Felmet | 83/698.91 X |
| 3,205,742 | 9/1965 | Williamson | 83/686 X |
| 3,548,700 | 12/1970 | Herzog et al. | 83/698.91 |
| 3,926,082 | 12/1975 | Von Lagendorff | 83/699.31 X |
| 4,141,264 | 2/1979 | Weisbeck | 83/698.91 X |
| 4,457,196 | 7/1984 | Cady | 83/698.91 X |
| 5,020,407 | 6/1991 | Brinlee | 83/698.91 X |
| 5,054,347 | 10/1991 | Johnson et al. | 83/698.91 X |
| 5,131,303 | 7/1992 | Wilson et al. | 83/699.41 X |

FOREIGN PATENT DOCUMENTS 0 646 427 4/1995 European Pat. Off. .

*Primary Examiner*—Eugenia Jones
*Attorney, Agent, or Firm*—Larson & Taylor

[57] ABSTRACT

A punch unit includes a punch driver having a punch connected to it. A guide bushing receives the punch for guiding its axial displacement. A compression spring urges the punch driver rearwardly, away from the guide bushing. An intermediate member located between the guide bushing and the compression spring includes a collar, a holding member positioned concentrically inside the collar and releasable retaining means. The collar is rotatable relative to the holding member such that rotation in a first direction moves the retaining means into a locked position in which the guide bushing is prevented from moving longitudinally out of said holding member and rotation of the collar in a second direction opposite to the first direction moves the retaining means into an unlocked position in which the guide bushing is removable from the holding member. An indexing pin, also located in the intermediate member, releasably engages selected detent seats in the guide bushing to establish the rotational position of the guide bushing and hence also the punch length.

20 Claims, 4 Drawing Sheets

PUNCH UNIT

FIELD OF THE INVENTION

The invention relates to a punch unit, and, more particularly, to a punch unit which may be quickly disassembled for removal and replacement of the punch without the use of tools and which allows for simplified adjustment of the punch length.

BACKGROUND OF THE INVENTION

In general, a punch unit includes a punch driver connected with a punch. The punch driver has a punch head at its back end and means for preventing relative rotation of the punch and the punch driver during a stroke of the punch. The back end of the punch is usually screw threaded into a bore at the front end of the punch driver. A pre-loaded compression means such a compression spring is provided between the punch head and a guide bushing which receives the punch to return the punch and punch driver to their rearward position. Typically, the guide bushing is connected to the remainder of the punch unit in such a manner that disassembly for removal or exchange of the punch is cumbersome. Procedures for punch length adjustment are also generally cumbersome.

Accordingly, the need exists to provide an improved punch unit having a simplified means for removing the guide bushing. A need also exists for a simplified means for effecting punch length adjustment.

SUMMARY OF THE INVENTION

It is therefore the primary object of the invention to provide a punch unit which permits a simpler and more rapid installation and removal of the punch.

According to a preferred embodiment of the invention, a punch unit includes a punch driver having front and back ends. A punch head is positioned on the back end of the punch driver and a punch is connected to the front end of the punch driver. A guide bushing receives the punch for guiding axial displacement of the punch. The punch unit further includes means for preventing rotation of the punch relative to the guide bushing during punching. A compression spring urges the punch rearwardly away from the guide bushing. An intermediate member includes a collar and a holding member positioned concentrically inside the collar. The holding member includes releasable retaining means for retaining the guide bushing therein. The collar is rotatable relative to the holding member such that rotation in a first direction moves the retaining means into a locked position in which the guide bushing is prevented from moving longitudinally out of the holding member and rotation of the collar in a second direction opposite to the first direction moves the retaining means into an unlocked position in which the guide bushing is removable from the holding member.

Preferably, the retaining means is in the form of retaining balls movable in bores in a side wall of the holding member such that in the locked position, the collar pushes the retaining balls inwardly into the holding member to engage two lip portions, forming a recess therebetween, in the guide bushing, and in the unlocked position, the retaining balls are movable outwardly away from the guide bushing into notched portions in the side wall of the collar. The retaining means may also include a locking spring for biasing the collar into the locked position.

In the preferred embodiment, the retaining means is movable into the locked position by means of a locking mechanism pin in an inner portion of the holding member which prevents rotation of the collar relative to the holding member in the unlocked position. The locking mechanism pin is engaged by the guide bushing during insertion into the holding member.

The punch unit of the invention also preferably includes indexing means for controlling relative rotation of the guide bushing with respect to the holding member. The indexing means is movable between a secured position in which rotation between the guide bushing and the holding member is prevented and a released position wherein the guide bushing and the holding member are rotatable relative to one another. The indexing means may include means for allowing discrete rotational adjustments of the guide bushing relative to the intermediate member, whereby the length of the punch is adjustable in discrete amounts. The means for allowing discrete rotational adjustments is typically in the form of detent seats positioned at measured increments around the circumference of the guide bushing and an indexing pin on the intermediate member for engaging one of the detent seats.

It is, therefore, an object of the invention to provide a punch unit in which the punch may be removed and replaced through simplified disassembly and removal of the guide bushing.

It is another object of the invention to provide a punch unit in which the guide bushing is rotatable in discrete amounts so as to effect known changes in punch length.

It is still another object of the invention to provide easily accessible securing means, which is simple to operate, positioned on an exterior of the punch unit to selectively prevent or allow rotation of the guide bushing and punch relative to the punch head.

These and other objects of the present invention will become apparent from the detailed description to follow.

BRIEF DESCRIPTION OF THE DRAWINGS

There follows a detailed description of the preferred embodiments of the present invention which are to be taken together with the accompanying drawings, wherein.

DETAILED DESCRIPTION OF THE PREFERRED EMBODIMENTS

Referring now to the figures, like elements are represented by like numerals throughout the several views.

Figure 1:
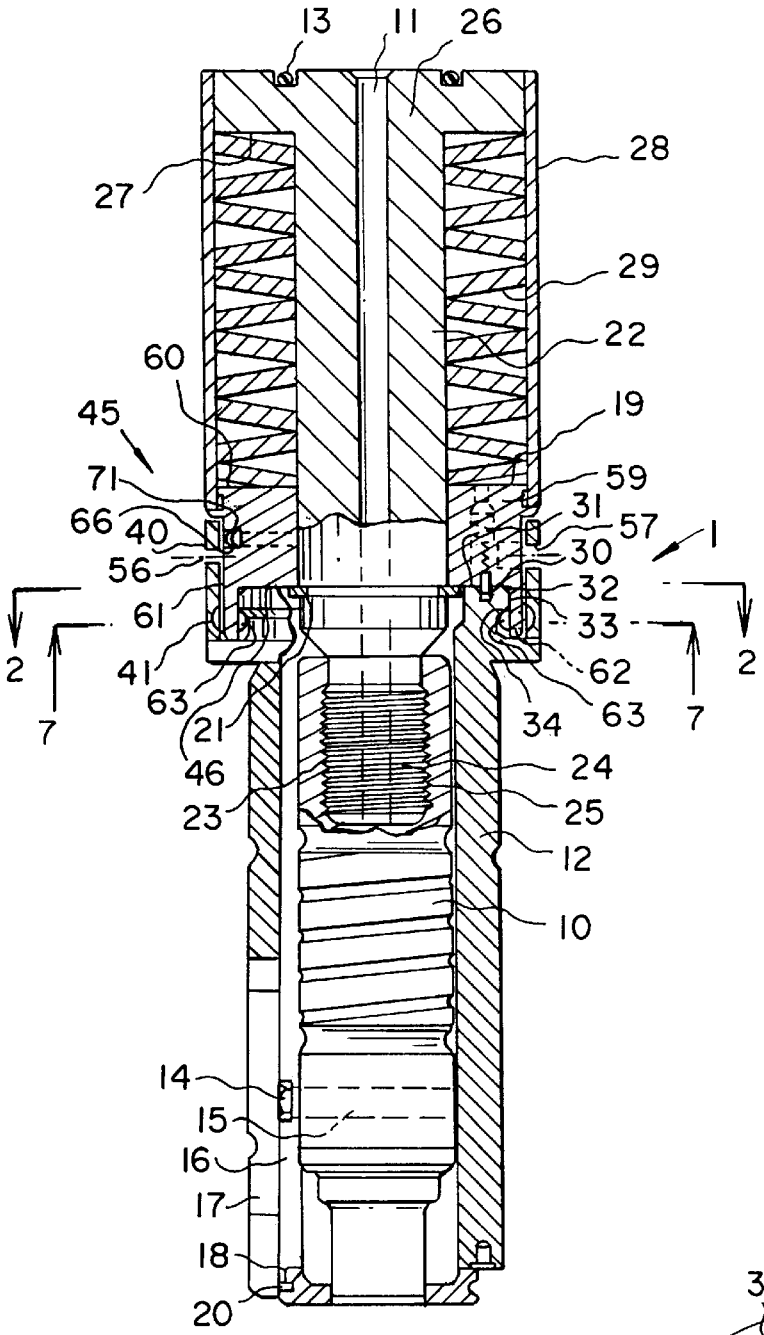
FIG. 1 is a central longitudinal cross-sectional view of the punch unit in the completely assembled state.

The punch unit 1 represented in FIG. 1 comprises a punch 10 guided linearly displaceably in a guide bushing 12. Rotation of the punch 10 in relation to the guide bushing 12 is prevented by rotation preventing means such as a pin 14 fixed to a punch 10, and engages an interior longitudinal groove 16 in the guide bushing 12. Axial groove 17 is open radially outwardly so that means on the machine frame, not shown, can engage the groove 17 from the outside and non-rotatingly maintain it on the machine frame. Stripper plate 18 is removably fastened on the lower end of the guide bushing 12.

The back or upper end of punch 10 is connected to a punch driver 22. To be able to compensate for the loss of length because of the wear and regrinding of the punch, there is a threaded connection between the punch 10 and the punch driver 22 which permits the adjustment of the punch length. In the embodiment shown in FIG. 1, the back end of the punch 10 is provided with a threaded bore 23 into which the front end 24 of the punch driver 22, which is provided with an exterior thread 25, is screwed. The total length of the punch 10 and the punch driver 22 is set by screwing the front end 24 of the punch driver 22 into the threaded bore 23 of the punch 10 by varying amounts.

A punch head 26, seated at the back of the punch driver 22, receives the force generated by a punching machine (not shown) to actuate the punch unit 1. The punch head 26 acts as a back stop surface to receive the force of a compression means, such as a compression spring 29, for urging the punch driver 22 rearwardly away from the guide bushing 12. Spring 29 may be positioned inside a slip-on bushing 28. The interior diameter of compression spring 29 is such that the punch 10 and the shaft of the punch driver 22 can be guided through it.

Figure 2:
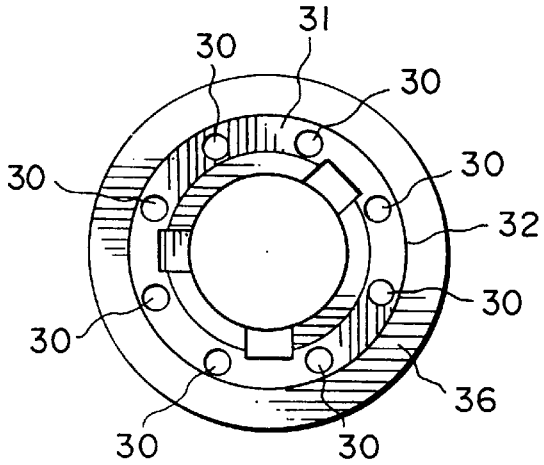
FIG. 2 is a top view of the guide bushing with the punch removed taken along line 2—2 of FIG. 1.
Figure 3:
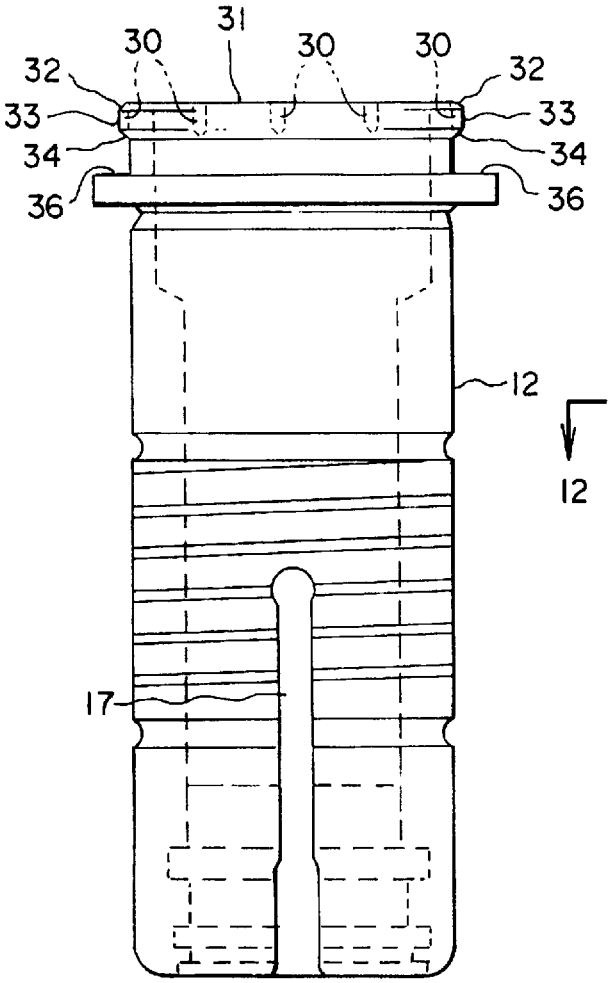
FIG. 3 is a side elevational view of the guide bushing with the punch removed.

Slip-on bushing 28 is fixedly connected to the back or upper end of an intermediate member 45 by a frictional connection with lip portion 60. The punch driver 22 extends through a central opening in the intermediate member 45 and is held securely therein by a C-clamp 21. The guide bushing 12 is, in turn, connected to the intermediate member 45 in such a way as to be rotatable with respect to the intermediate member 45 and, thus also with respect to the slip-on bushing 28. In a preferred embodiment shown in FIGS. 2 and 3, the top end 31 of guide bushing 12 includes multiple detent seats 30 positioned at measured increments around the circumference. The detent seats 30 have a sufficient depth to receive an indexing pin 51 positioned in the intermediate member 45 as best shown in FIGS. 4 and 5.

The intermediate member 45 includes an outer collar 40 and an interior holding member 59 positioned concentrically inside the collar 40. The collar 40 rotates by a fixed number of degrees with respect to the holding member 59 between a locked position in which the guide bushing 12 is retained in the holding member 59 and an unlocked position in which the guide bushing 12 may be removed, as discussed in greater detail below in connection with FIGS. 7–12. Indexing pin 51 is secured to a radial protrusion 50 in the holding member 59 which extends through an indexing guide groove 49 in the collar 40 such that the radial protrusion 50 is accessible.

Figure 4:
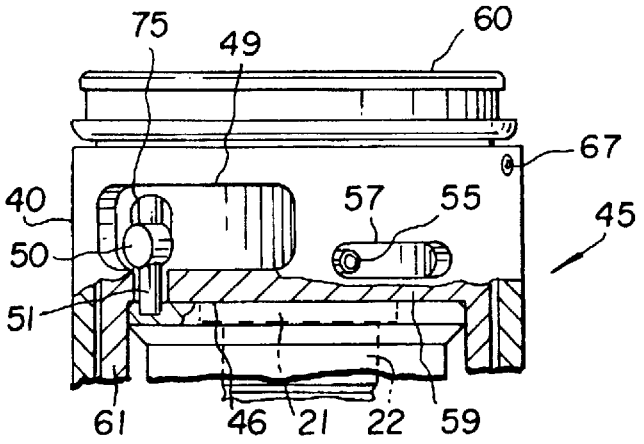
FIG. 4 is a side elevational view of the intermediate member of the punch unit with portions shown in cross-section of the indexing means in the locked position.
Figure 5:
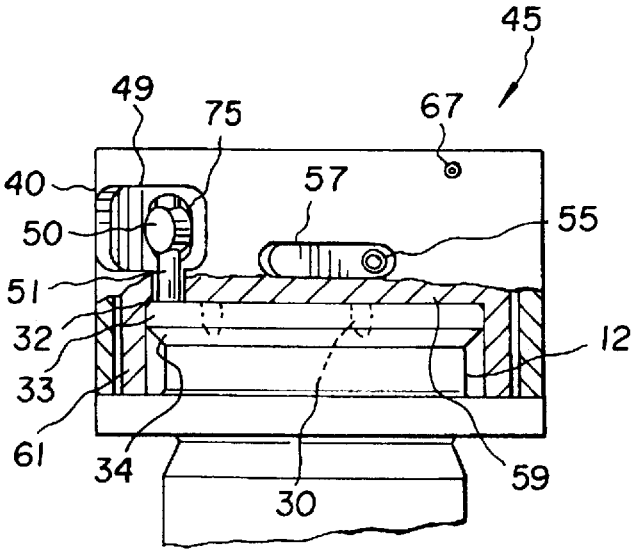
FIG. 5 is a side elevational view similar to FIG. 4, but in the unlocked position.
Figure 6:
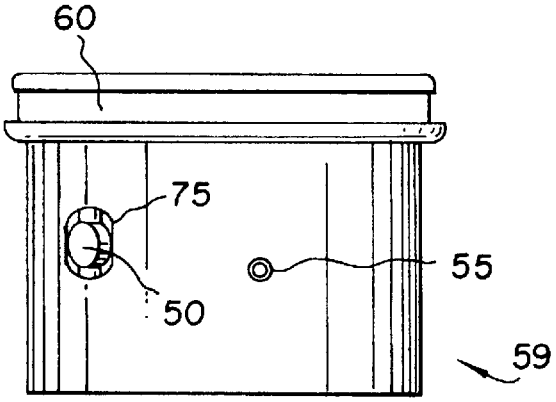
FIG. 6 is a side elevational view as shown in FIG. 4 with the collar removed.

FIGS. 4–6 illustrate the operation of the indexing pin. FIG. 4 shows the intermediate member 45 in the locked position. Indexing pin 51 is shown in its normal position, i.e., biased downward by a spring (not shown) such that it extends outward from the bottom 46 of the holding member 59. When the guide bushing 12 is inserted into the holding member 59, the indexing pin 51 moves into a secured position wherein it enters one of the detent seats 30 to prevent relative rotation between the guide bushing 12 and the intermediate member 45. In order to rotate the guide bushing 12 relative to the intermediate member 45 and thereby adjust the punch length, one simply moves indexing pin 51 in an upward direction, against the spring biasing force, by moving radial protrusion 50 upwardly to a released position wherein it becomes flush with or into bottom 46 as shown in FIG. 5. Guide bushing 12 can then be rotated a selected number of increments to effectuate an increase or decrease in punch length. Upon release of radial protrusion 50, indexing pin 51 will enter another detent seat 30 to again move into the secured position, preventing relative rotation between the guide bushing 12 and the intermediate member 45. Pin 51 is also shown in FIG. 8.

Figure 11:
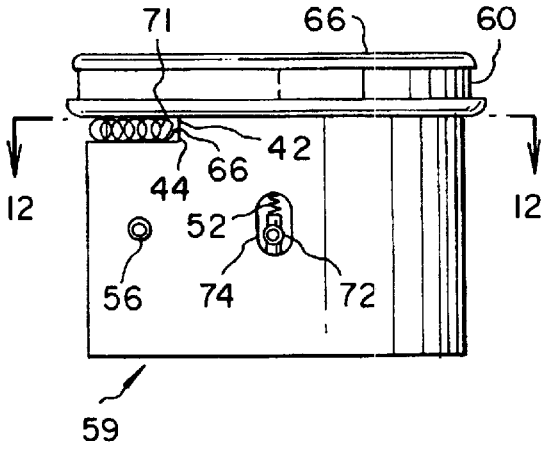
FIG. 11 is a side elevational view as shown in FIGS. 9 and 10 with the collar removed.
Figure 12:
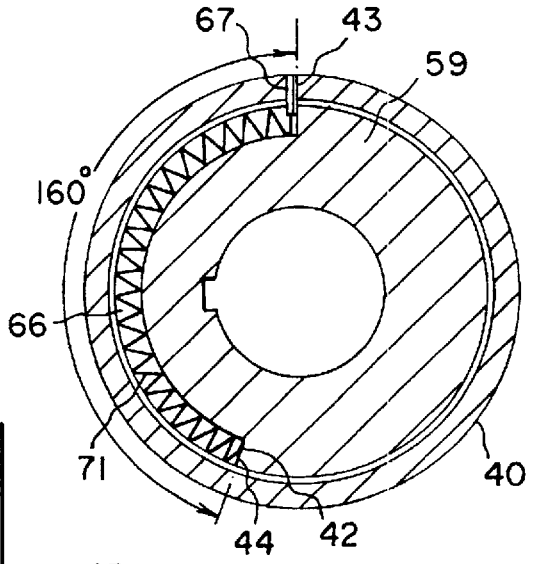
FIG. 12 is a cross-sectional view along line 12—12 of FIGS. 9–11 with the punch driver removed.

As can be seen in FIG. 6, longitudinal movement of the indexing pin 51 is guided by a first interior guide groove 75 in the side wall 61 of the holding member 59 through which the radial protrusion 50 extends. A first guide pin 55 mounted on the wall 61 of the holding member 59 extends outward through a first exterior guide groove 57 in the collar 40 to guide rotational movement of the collar 40 with respect to the holding member 59. A second guide pin 56 is similarly mounted, for the same purpose, at a position on the wall 61 approximately 180 degrees from first guide pin 55 and extends through a second exterior guide groove 58 in the collar 40 as shown in FIGS. 9–11, discussed in greater detail below.

Figure 8:
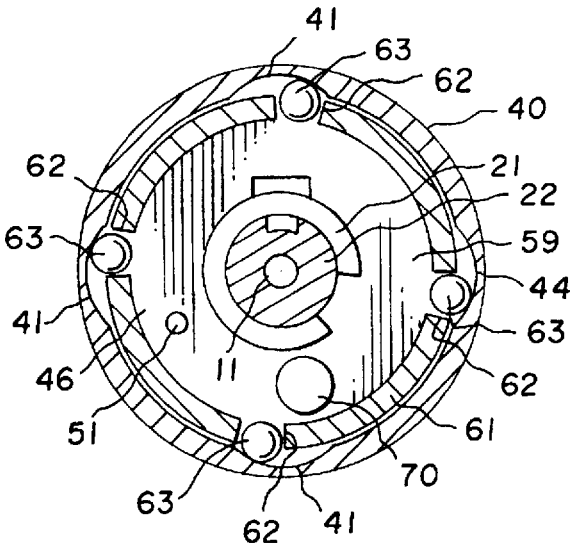
FIG. 8 is a cross-sectional view similar to FIG. 7 but with the guide bushing removed.
Figure 7:
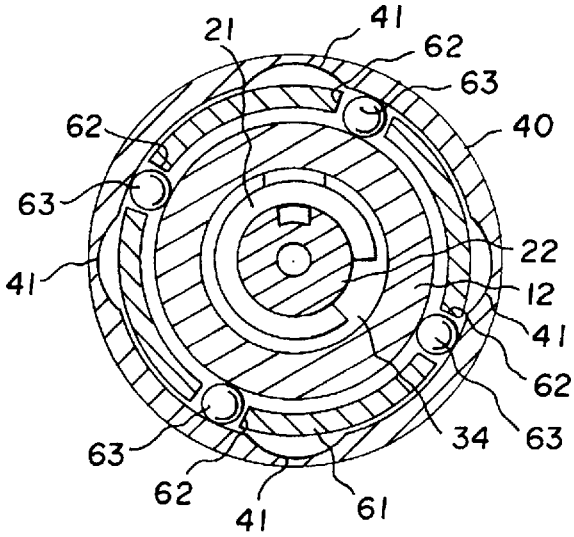
FIG. 7 is a cross-sectional view along line 7—7 of FIG. 1.

FIGS. 7–12 illustrate the guide bush securing and disassembly means. Referring to FIGS. 7 and 8, the holding member 59 further includes releasable retaining means for releasably retaining the guide bushing therein. This allows rapid disassembly of the guide bushing from the remaining punch unit 1 without the need for tools. Thus, the punch 10 is easily replaced if it is worn down or exchanged with a different shaped punch. Preferably, the releasable retaining means comprises bores 62 extending radially through side wall 61 of the holding member 59 and retaining balls 63 seated in the bores 62 and having a diameter which exceeds the depth of side wall 61. The retaining balls 63 are movable within the bores 62 but have a diameter less than bores 62 so that they cannot come out of bores 62. (The bores 62 are shown larger than the diameter of balls 63 in the figures solely for purposes of illustration.) In the embodiment shown, there are four retaining balls 63, although there may be more or less thereof. When the guide bushing 12 is fully inserted into the holding member 59 such that its top end 31 is adjacent holding member bottom 46, as shown in FIG. 1, collar 40 pushes the retaining balls 63 inwardly as shown in FIG. 7 toward the guide bushing 12 such that the retaining balls 63 are firmly seated in a recess 47 (see also FIG. 3) between a first bevelled edge 34 and stop surface 36 to prevent removal of the guide bushing 12 from the intermediate member 45, while allowing rotation of the guide bushing 12 with respect to the holding member 59.

Figure 10:
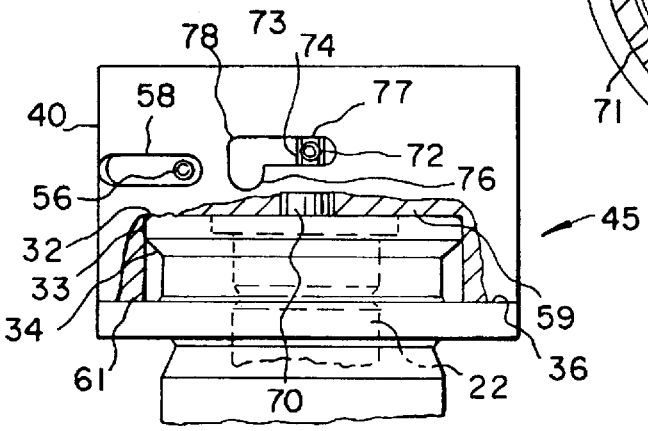
FIG. 10 is a side elevational view similar to FIG. 9, but with the guide bushing inserted and in the locked position.
Figure 9:
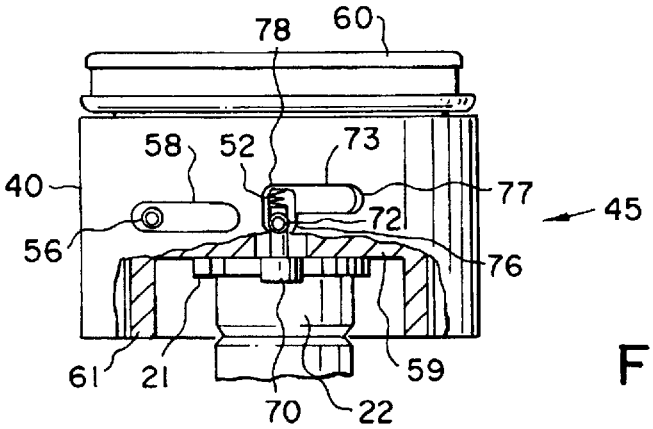
FIG. 9 is a side elevational view with portions shown in cross-section of the intermediate member of the punch unit with the guide bushing removed and rotated approximately 90 degrees from the view in FIGS. 4–6 and showing the guide bushing disassembly means in the unlocked position.

In order to remove the guide bushing 12 from the intermediate member 45, the collar 40 is simply rotated with respect to the holding member 59 from the position of FIG. 10 to the position of FIG. 9. As this rotation occurs, the notches 41 in the interior of the collar 40 become radially aligned with retaining balls 63, as shown in FIG. 8. The degree to which collar 40 may be rotated with respect to holding member 59 is fixed by the ends of an L-shaped guide groove 73 in the collar 40 through which a locking mechanism guide pin 72, seated in the holding member 59, extends. When collar 40 is rotated from the position shown in FIG. 10 and FIG. 7 to the position shown in FIG. 9 and FIG. 8, the locking mechanism guide pin 72 moves down into the shorter leg 78 of the L-shaped guide groove 73. The locking pin 70, attached to locking mechanism guide pin 72, is then forced downward under the action of biasing spring 52 and presses against top end 31 of the guide bushing 12. During this movement, first bevelled edge 34 simultaneously presses against retaining balls 63 which are then forced into the bores 62 by outer portion 33 such that retaining balls 63 move into notches 41. Thus, as locking pin 70 moves out of the holding member bottom 46, the guide bushing 12 is forced out of the holding member 59 such that it may be removed from the punch unit 1.

Conversely, when the guide bushing 12 is inserted into the holding member 59, top end 31 presses against locking pin 70, compressing biasing spring 52 and forcing locking mechanism guide pin 72 upward and out of the leg 78. To further facilitate insertion of the guide bushing 12 into the intermediate member 45, the outer rim of the top end 31 of guide bushing 12 forms a second beveled edge 32 which tends to push the retaining balls 63 into the bores 62 toward notches 41 so that outer portion 33 may pass the retaining balls 63. As pin 72 moves out of leg 78, spring 71 (see FIGS. 11 and 12) is now free to rotate the collar 40 with respect to the holding member 59 so that pin 72 moves to the other end of groove 73. As explained above in connection with FIGS. 7 and 8, when the collar 40 is rotated in this manner, collar 40 holds the retaining balls 63 inwardly against the guide bushing 12 such that the retaining balls 63 are firmly seated in the recess 47 formed between the first bevelled edge 34 and the stop surface 36 to prevent removal the guide bushing 12 from the intermediate member 45. As shown in FIG. 11, movement of the locking mechanism 70 is guided by a second interior guide groove 74 in the side wall 61 of the holding member 59 through which the locking mechanism guide pin 72 extends.

In order to ensure that the intermediate member 45 remains in the locked position, i.e., that locking mechanism guide pin 72 does not inadvertently move out of the long end 77 of the L-shaped guide groove 73, a locking spring 71 biases the collar 40 in the direction of the locked position. Locking spring 71 is seated in a locking spring retaining groove 66 in the holding member 59, shown most clearly in FIG. 12. In a preferred embodiment, the locking spring retaining groove 66 extends approximately 160 degrees around the circumference of the holding member 59. A first end 42 of the locking spring 71 is secured to a ledge 44 in the holding member 59 and a second end 43 is fixed to an anchor pin 67 on the collar 40. Preferably, the locking spring 71 is maintained in compression such that in the locked state, the locking spring 71 is more compressed than in the unlocked state. When the locking mechanism guide pin 72 enters the leg 78 of the L-shaped groove 73, it is then forced toward the long end 77 of the L-shaped guide groove 73 under the biasing action of the locking spring 71.

Although the invention has been described in considerable detail with respect to preferred embodiments thereof, variations and modifications will be apparent to those skilled in the art without departing from the spirit and scope of the invention set forth in the claims.

We claim:

1. A punch unit comprising:

a punch driver having front and back ends;

a punch head positioned on said back end of the punch driver;

a punch having a back end connected to said front end of said punch driver;

a guide bushing receiving said punch for guiding axial displacement of said punch;

means for preventing rotation of said punch relative to said guide bushing during punching;

a compression means for urging the punch driver rearwardly away from said guide bushing; and an intermediate member between the guide bushing and the compression means, said intermediate member comprising a collar and a holding member positioned inside said collar, said holding member including releasable retaining means for releasably retaining the guide bushing, said collar being rotatable relative to said holding member such that rotation in a first direction moves said retaining means into a locked position wherein said guide bushing is prevented from moving out of said holding member and rotation of said collar in a second direction opposite to said first direction moves said retaining means into an unlocked position wherein said guide bushing is removable from said holding member.

2. The punch unit as claimed in claim 1 wherein said retaining means comprises retaining balls movable in bores in a side wall of said holding member such that in the locked position, said collar pushes said retaining balls inwardly into said holding member to engage said guide bushing, and in said unlocked position, said retaining balls are movable outwardly away from said guide bushing.

3. The punch unit as claimed in claim 2 wherein said collar includes notched portions in a side wall adjacent to said holding member such that said retaining balls are movable into said notched portions in said unlocked position.

4. The punch unit as claimed in claim 2 wherein said guide bushing includes two lip portions forming a recess therebetween for receiving said retaining balls.

5. The punch unit as claimed in claim 1 wherein said retaining means includes a locking spring for biasing said collar into said locked position.

6. The punch unit as claimed in claim 5 wherein said locking spring is housed in a retaining groove in a wall in said holding member, said locking spring being attached at one end to said retaining groove and attached at an opposite end to said collar.

7. The punch unit as claimed in claim 1 further comprising a locking mechanism pin in an inner portion of said holding member, said locking mechanism pin being engaged by said guide bushing during insertion into said holding member for moving said retaining means into said locked position.

8. A punch unit as claimed in claim 7 further comprising a locking mechanism guide pin and an L-shaped groove in said collar, said locking mechanism pin being attached to said locking mechanism guide pin, said locking mechanism guide pin being movable between short and long ends of said L-shaped groove to respectively prevent and allow movement of said collar relative to said, holding member.

9. The punch unit as claimed in claim 1 wherein said holding member includes at least one guide pin extending outward from a side wall thereof through a corresponding groove extending around a portion of a circumference of said collar to guide movement of said collar with respect to said holding member.

10. The punch unit as claimed in claim 1 further comprising indexing means for controlling relative rotation of said guide bushing with respect to said holding member, said indexing means being movable between a secured position in which rotation between said guide bushing and said holding member is prevented and a released position wherein said guide bushing and said holding member are rotatable relative to one another.

11. The punch unit as claimed in claim 10 wherein said indexing means includes means for allowing discrete rotational adjustments of said guide bushing relative to said intermediate member, whereby combined length of said punch and said punch driver is adjustable in discrete amounts.

12. The punch unit as claimed in claim 11 wherein said means for allowing discrete rotational adjustments comprises detent seats positioned at measured increments around the circumference of said guide bushing and an indexing pin on said intermediate member for engaging a selected one of said detent seats.

13. The punch unit as claimed in claim 12 further comprising a radial protrusion attached to said indexing pin and extending radially outward from said collar for moving said indexing pin between said secured and released positions.

14. A punch unit comprising:

a punch driver having front and back ends;

a punch head positioned on said back end of the punch driver;

a punch having a back end connected to said front end of said punch driver;

a guide bushing receiving said punch for guiding axial displacement of said punch;

means for preventing rotation of said punch relative to said guide bushing during punching;

a compression means urging the punch driver rearwardly away from said guide bushing;

an intermediate member positioned between the guide bushing and the compression means, said intermediate member including releasable retaining means movable between a locked position wherein said guide bushing is prevented from moving out of said intermediate member and an unlocked position wherein said guide bushing is removable from said intermediate member, said releasable retaining means allowing relative rotation of said guide bushing with respect to said intermediate member in the locked position; and indexing means for controlling relative rotation of said guide bushing with respect to said intermediate member, said indexing means being movable between a secured position in which rotation between said guide bushing and said intermediate member is prevented and a released position wherein said guide bushing and said intermediate member are rotatable relative to one another.

15. The punch unit as claimed in claim 14 wherein said intermediate member comprises a collar and a holding member positioned concentrically inside said collar, said releasable retaining means being positioned in said holding member, said collar being rotatable relative to said holding member such that rotation in a first direction moves said retaining means into a locked position wherein said guide bushing is prevented from moving longitudinally out of said holding member and rotation of said collar in a second direction opposite to said first direction moves said retaining means into an unlocked position wherein said guide bushing is removable from said holding member.

16. The punch unit as claimed in claim 15 wherein said retaining means comprises retaining balls movable in bores in a side wall of said holding member such that in the locked position, said collar pushes said retaining balls inwardly into said holding member to engage said guide bushing, and in said unlocked position, said retaining balls are movable outwardly away from said guide bushing and into notched portions in a side wall of said collar adjacent to said holding member.

17. The punch unit as claimed in claim 16 wherein said guide bushing includes two lip portions forming a recess therebetween for receiving said retaining balls.

18. The punch unit as claimed in claim 16 wherein said retaining means includes a locking spring for biasing said collar into said locked position, said locking spring being housed in a retaining groove in a wall in said holding member and attached at one end to said retaining groove and attached at an opposite end to said collar.

19. The punch unit as claimed in claim 15 further comprising a locking mechanism pin in an inner portion of said holding member, a locking mechanism guide pin and an L-shaped groove in said collar, said locking mechanism pin being engaged by said guide bushing during insertion into said holding member, said locking mechanism pin being attached to said locking mechanism guide pin, said locking mechanism guide pin being movable between short and long ends of said L-shaped groove to respectively prevent and allow movement of said collar relative to said holding member.

20. The punch unit as claimed in claim 14 wherein said intermediate member and said indexing means include means for allowing discrete rotational adjustments of said guide bushing relative to said intermediate member, said means for allowing discrete rotational adjustments comprising detent seats positioned at measured increments around the circumference of said guide bushing and an indexing pin on said intermediate member for engaging a selected one of said detent seats, said punch unit further comprising a radial protrusion attached to said indexing pin and extending radially outward from said intermediate member for moving said indexing pin between said secured and released positions.

* * * * *